US006986830B2

(12) United States Patent
Scherb et al.

(10) Patent No.: US 6,986,830 B2
(45) Date of Patent: Jan. 17, 2006

(54) METHOD AND A MACHINE FOR THE MANUFACTURE OF A FIBER WEB

(75) Inventors: Thomas Thoröe Scherb, Sao Paulo (BR); Harald Schmidt-Hebbel, Barueri (BR); Jeffrey Herman, Bala Cynwyld, PA (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/742,401

(22) Filed: Dec. 19, 2003

(65) Prior Publication Data

US 2004/0244933 A1 Dec. 9, 2004

Related U.S. Application Data

(63) Continuation of application No. PCT/EP02/05807, filed on May 27, 2002.

(51) Int. Cl.
*D21F 11/00* (2006.01)
*D21F 11/14* (2006.01)

(52) U.S. Cl. ..... 162/202; 162/109; 162/203; 162/358.4; 162/363; 162/368; 162/301; 162/903; 162/348

(58) Field of Classification Search ..... 162/109, 162/111–113, 202–207, 358.1, 358.3, 359, 162/358.4, 361, 362, 363, 367, 368, 300–301, 162/348, 903
See application file for complete search history.

(56) References Cited

U.S. PATENT DOCUMENTS 3,059,312 A * 10/1962 Jamieson ..... 442/224
3,617,442 A * 11/1971 Hurschman ..... 162/212
3,812,000 A * 5/1974 Salvucci, Jr. et al. ..... 162/111
3,821,068 A * 6/1974 Shaw ..... 162/111
4,036,684 A 7/1977 Schmitt et al. ..... 162/290
4,102,737 A 7/1978 Morton ..... 162/113
4,236,963 A 12/1980 Busker ..... 162/271
4,369,081 A * 1/1983 Curry et al. ..... 156/148
4,931,010 A * 6/1990 Barnewall ..... 442/323
5,002,801 A * 3/1991 Barnewall ..... 427/209
5,397,437 A * 3/1995 Ingemar ..... 162/203
5,846,380 A 12/1998 Van Phan et al. ..... 162/111
5,932,068 A * 8/1999 Farrington et al. ..... 162/117
6,042,692 A * 3/2000 Myren ..... 162/281
6,077,398 A * 6/2000 Fiscus et al. ..... 162/361
6,103,062 A 8/2000 Ampulski et al. ..... 162/109
6,209,224 B1 * 4/2001 Chuang ..... 34/448
6,235,160 B1 * 5/2001 Tietz et al. ..... 162/358.5
6,248,210 B1 * 6/2001 Edwards et al. ..... 162/111

(Continued)

FOREIGN PATENT DOCUMENTS

DE 694 17 068 12/1994

(Continued)

*Primary Examiner*—José A. Fortuna
(74) *Attorney, Agent, or Firm*—Taylor & Aust, P.C.

(57) ABSTRACT

A method and machine for the manufacture of a fiber web, in particular of a tissue web or of a hygienic web, in which the fiber web is formed on a soft clothing with fine pores and the clothing is guided over a surface subject to suction and in which the fiber web is transferred from a soft clothing with fine pores directly onto a TAD wire of a TAD drying apparatus. An optimum quality of the respective final product is achieved with an energy effort which is as low as possible, in particular, the energy effort required with vacuum generation in the dewatering of the fiber web is reduced.

72 Claims, 3 Drawing Sheets

U.S. PATENT DOCUMENTS

| | | | | |
|---|---|---|---|---|
| 6,350,349 | B1 * | 2/2002 | Hermans et al. | 162/111 |
| 6,488,816 | B1 * | 12/2002 | Klerelid | 162/359.1 |
| 6,524,445 | B1 * | 2/2003 | Otto et al. | 162/361 |
| 6,758,943 | B2 * | 7/2004 | McConnell et al. | 162/158 |
| 6,780,282 | B2 * | 8/2004 | Scherb et al. | 162/111 |
| 2002/0060043 | A1 * | 5/2002 | Scherb et al. | 162/358.1 |
| 2002/0060046 | A1 * | 5/2002 | Scherb et al. | 162/358.1 |
| 2002/0179269 | A1 * | 12/2002 | Klerelid | 162/206 |
| 2003/0019601 | A1 * | 1/2003 | Hermans et al. | 162/207 |
| 2003/0098134 | A1 * | 5/2003 | Scherb et al. | 162/117 |
| 2003/0136018 | A1 * | 7/2003 | Herman et al. | 34/114 |
| 2004/0018369 | A1 * | 1/2004 | Goulet et al. | 428/535 |
| 2004/0237210 | A1 * | 12/2004 | Thoroe-Scherb et al. | 8/115.51 |

FOREIGN PATENT DOCUMENTS

| | | | |
|---|---|---|---|
| DE | 10130038 | A1 * | 1/2003 |
| EP | 0 874 083 | | 4/1997 |
| GB | 1 365 230 | | 6/1971 |
| GB | 2 006 296 | | 10/1977 |
| WO | WO 93/00475 | | 6/1991 |
| WO | WO 97/03247 | | 7/1995 |
| WO | WO 99/47749 | | 3/1998 |
| WO | WO 01/00925 | | 6/1999 |

* cited by examiner

METHOD AND A MACHINE FOR THE MANUFACTURE OF A FIBER WEB

CROSS REFERENCE TO RELATED APPLICATIONS

This is a continuation of PCT application No. PCT/EP02/05807, entitled "METHOD AND MACHINE FOR THE PRODUCTION OF A FIBRE WEB", filed May 27, 2002.

BACKGROUND OF THE INVENTION

1. Field of the Invention

The present invention relates to a method and to a machine for the manufacture of a fiber web, and, more particularly, to the manufacture of a tissue web or of a hygienic web.

2. Description of the Related Art

The use of so-called throughflow apparatuses or TAD drying apparatuses (TAD= through air drying) in paper making machines is known (see for example WO 97/03247, U.S. Pat. No. 4,036,684). The TAD units have previously made up a large part of the total costs of the respective paper making machines. The energy requirements for a TAD machine with a dual wire former is very high and, in particular, much higher than, for example, those for a crescent former. For example, approximately 12 vacuum pumps have thus been required up to now in one TAD machine in order to achieve the desired dry content and degree of cleansing.

In a conventional TAD machine with, for example, a dual wire former, the web must be transferred from the forming zone to the TAD zone, with the desired dry content being able to lie on the web transfer, for example, in a range from approximately 22 to approximately 26.5%, depending on the basis weight. The web is then guided with this dry content, for example, to a wet suction box effecting a wet imprinting (wet molding) and then to the TAD drum. The named dry content has previously only been achieved, however, with a relatively high energy effort.

What is needed in the art is an improved method and an improved machine with which an optimum quality of the respective final product can be achieved with an energy effort which is as low as possible. In particular the energy effort required in connection with the vacuum generation in the dewatering of the fiber web should be reduced in this process.

SUMMARY OF THE INVENTION

In accordance with the present invention, a method for the manufacture of a fiber web, in particular of a tissue web or of a hygienic web, in which the fiber web is formed on a soft clothing with fine pores and the clothing is guided over a surface subject to suction and in which the fiber web is transferred from a soft clothing with fine pores directly onto a TAD wire of a TAD drying apparatus.

An advantage of the present invention is that an optimum quality of the respective final product is achieved with an energy effort which is as low as possible, in particular, the energy effort required with vacuum generation in the dewatering of the fiber web is reduced.

An optimum dry content gain results with minimum energy effort due to the combination of the surface subject to suction or of the vacuum generated there with the soft clothing with fine pores. When an appropriate soft clothing with fine pores is used, the capillary effect of the clothing can in particular be used for the web dewatering. The respective underpressure is thus supported and facilitated by this capillary effect. A lower number of vacuum pumps for the forming zone also results in view of the lower energy requirements. The dry content desired at the transfer to the TAD section is therefore achieved with a lower number of vacuum pumps in the forming zone. The transfer of the fiber web to the TAD wire preferably takes place after the surface subject to suction. The surface subject to suction is expediently curved. It is preferably formed by a suction guide roll, a shoe subject to suction or the like.

In accordance with a preferred embodiment of the method in accordance with the invention, the fiber web is dewatered between two clothings which run together while forming a material inlet gap and are guided over a forming element such as a forming roll, with the fiber web being guided after the forming element, by the inner clothing coming into contact with it, to the surface subject to suction. Advantageously, in this process the outer clothing not coming into contact with the forming element can be formed by an endless fabric, preferably a water permeable endless fabric.

The forming element can be formed by a solid forming roll or by a suction forming roll. In accordance with a preferred practical embodiment, the fiber web is wet molded on the TAD wire. The wet molding can take place at and/or after the web transfer position. It is advantageous, in certain cases for the two clothings to have a different running speed in order to produce a crepe effect acting on the fiber web.

The soft clothing with fine pores can in particular be formed by a felt, a capillary felt, a capillary membrane and/or the like. A coated wire, e.g. a wire with a foamed layer, and for example a felt with a foamed layer, can be used as the soft clothing with fine pores. In this case, the foam coating is preferably selected such that pores result in a range from approximately 3 to approximately 6 $\mu$m. The appropriate capillary effect is therefore used for the dewatering. The felt is provided with a special foam layer which gives the surface very small pores whose diameters can lie, for example, in the recited range from approximately 3 to approximately 6 $\mu$m. The air permeability of this felt is very low. The natural capillary effect is utilized for the dewatering of the web while it is in contact with the felt.

At least one suction element arranged inside the loop of the TAD wire can be used for the wet molding. A pick-up element or suction element can, for example, be provided inside the loop of the TAD wire in the region of the web transfer position for the support of the web transfer.

In accordance with an expedient practical embodiment, at least one suction element serving for the wet molding of the fiber web is provided inside the loop of the TAD wire in the region of the web transfer position and/or after the web transfer position. In accordance with a further advantageous embodiment of the method in accordance with the present invention, a shoe press is provided in the region of the web transfer position through which the fiber web is guided together with the soft clothing with fine pores and the TAD wire.

Advantageously, in this process the length of the press nip of the shoe press considered in the web running direction can be selected larger than a value of approximately 80 mm, and preferably larger than or equal to approximately 85 mm, and in particular larger than or equal to approximately 120 mm. The shoe press can be designed such that a pressure profile results over the press nip length with a maximum pressing pressure which is smaller than or equal to a value of approximately 2.5 MPa, and in particular smaller than 2 MPa, with a press shoe length of larger than or equal to approximately 120 mm. A gentle pressing with a low pressing pressure is thus ensured and a larger dwell time or pressing time is secured due to the shoe length, whereby the molding effect is improved.

The shoe press advantageously includes a shoe pressing unit, in particular a shoe press roll, and a wire roll cooperating with it and arranged inside the loop of the TAD wire. The pressing of the fiber web between the structured TAD wire and the soft clothing with fine pores effects the desired wet molding in this process. In this case, creping is not possible, i.e. there must not be any speed difference between the clothings.

In specific cases, it is also advantageous for the fiber web to be wet molded both by way of the shoe press and by way of a suction element provided after it. Wet molding is therefore generally possible at different positions.

In accordance with a preferred practical embodiment of the method in accordance with the present invention, a dewatering wire with zonally different wire permeability is used as the outer clothing not coming into contact with the forming element. In conjunction with the other method features, the advantage results therefrom of a higher water absorption speed of the fiber web, in particular of the tissue web or of the hygienic web.

The fiber web is expediently transferred from the TAD wire onto a drying cylinder, in particular onto a Yankee cylinder, after the TAD drying. A shoe pressing unit, in particular a shoe press, which is preferably wrapped around by a soft felt or by a capillary felt and which includes a longitudinal shoe, can be provided in this process inside the loop of the TAD wire in the transfer region. A reliable and gentle transfer of the web is thus ensured in which it is avoided that the three-dimensional structure of the fiber web produced by the wet molding and by the TAD process, and thus the web quality such as in particular the water retention capability, the water absorption speed and/or the like, is again reduced. The respective web transfer can generally, however, also be ensured by a suction press roll, and in particular by a press roll not subject to suction.

The machine in accordance with the present invention for the manufacture of a fiber web, in particular of a tissue web or of a hygienic web, is accordingly characterized in that the fiber web is formed on a soft clothing with fine pores and this clothing is guided over a surface subject to suction and in that the fiber web is transferred from a soft clothing with fine pores directly onto a TAD wire of a TAD drying apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
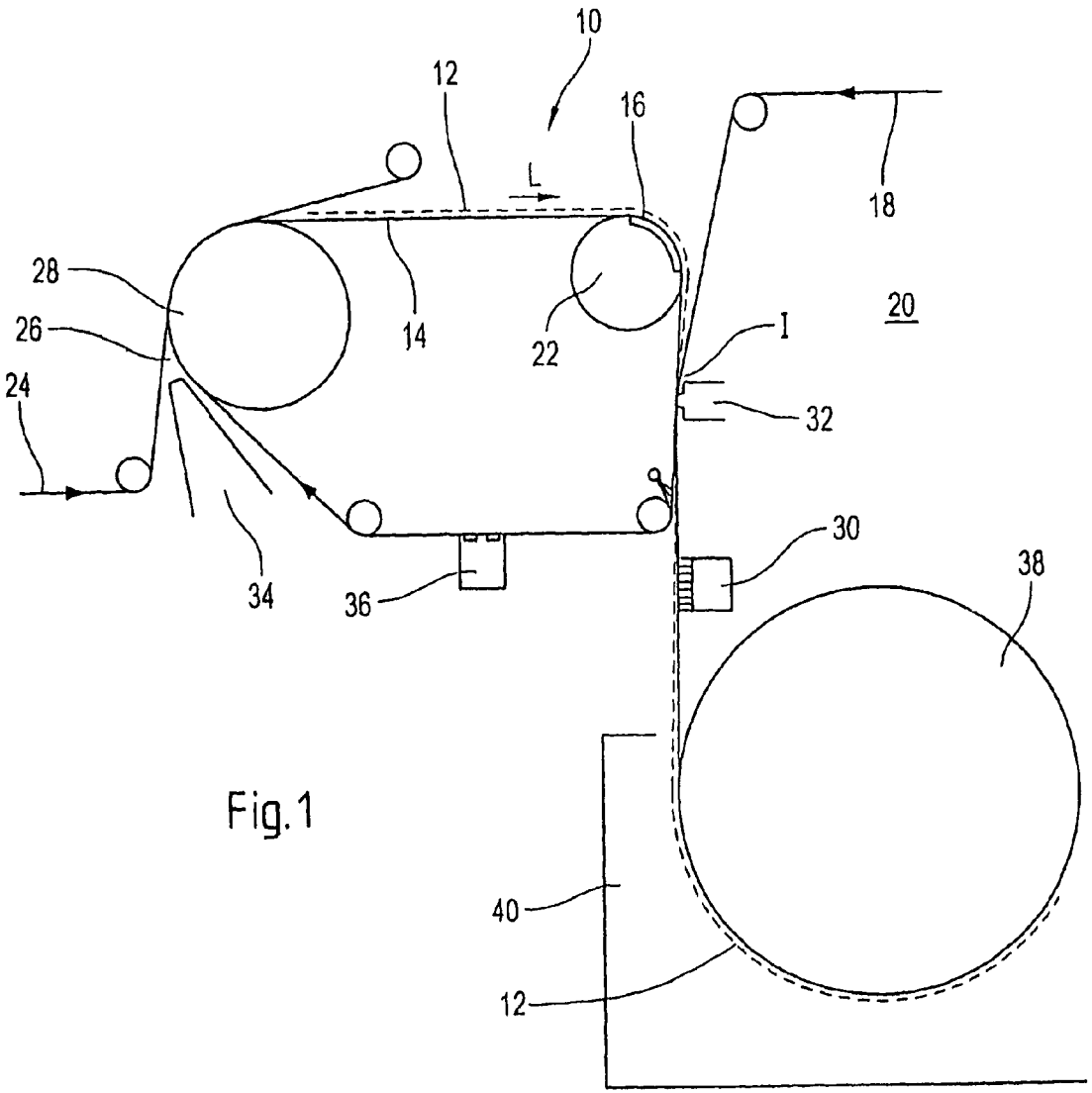
FIG. 1 is a schematic view of an embodiment of a machine for the manufacture of a fiber web according to the present invention.

Referring now to the drawings, and more particularly to FIG. 1, there is shown in a schematic partial representation a machine 10 for the manufacture of a fiber web 12 which can in particular be a paper web and preferably a tissue web or a hygienic web.

Fiber web 12 is formed on a soft clothing 14 with fine pores in machine 10. Clothing 14 is guided together with fiber web 12 formed thereon over a surface 16 subject to suction. Subsequent to this, fiber web 12 is transferred from soft clothing 14 with fine pores directly onto a TAD wire 18 of a TAD drying apparatus 20.

Fiber web 12 is therefore transferred from the same soft clothing 14 with fine pores directly onto TAD wire 18 on which it was formed. The transfer takes place in the web running direction L after surface 16 subject to suction. Surface 16 subject to suction is formed by a suction guide roll 22.

In the forming zone, fiber web 12 is dewatered between two clothings 14, 24 which run together while forming a material inlet gap and are guided over a forming element 28 such as in particular a forming roll. Fiber web 12 is guided after forming element 28, by inner clothing 14 coming into contact with forming element 28, to surface 16 subject to suction.

Outer clothing 24 not coming into contact with forming element 28 can in particular be formed by an endless fabric, preferably a water permeable endless fabric. Forming element 28 can be formed by a solid forming roll or also by a suction forming roll.

Fiber web 12 is wet molded on TAD wire 18. The wet molding can generally take place at and/or after web transfer position I.

In the present case, the two clothings 14, 24 have a different running speed in order to produce a crepe effect acting on fiber web 12. Soft clothing 14 with fine pores can in particular be formed by a felt, a capillary felt, a capillary membrane and/or the like. In particular a felt with a foamed layer can thus be used as soft clothing 14 with fine pores. In this process, the foam coating can in particular be selected such that pores result in a range from approximately 3 to approximately 6 $\mu$m.

At least one suction element arranged inside the loop of TAD wire 18 can be used for the wet molding. In the present case, only one such suction element 30 is used which is here provided, for example, after web transfer position I. Fiber web 20 is pulled toward TAD wire 18 by suction element 30 and thus wet molded.

A pick-up element or suction element 32 is provided inside the loop of TAD wire 18 in on of the web transfer position. The fiber suspension is introduced via a headbox 34 into material inlet gap 26 formed between two clothings 14, 24. Clothing 14 is conditioned by way of a so-called Uhle box 36, i.e. a tube suction box, after the transfer of fiber web 12 to TAD wire 18.

Subsequent to suction element 30, fiber web 12 is guided together with TAD wire 18 over a TAD drum 38 which, as can be recognized with reference to FIG. 1, is associated with a drying hood 40.

Figure 2:
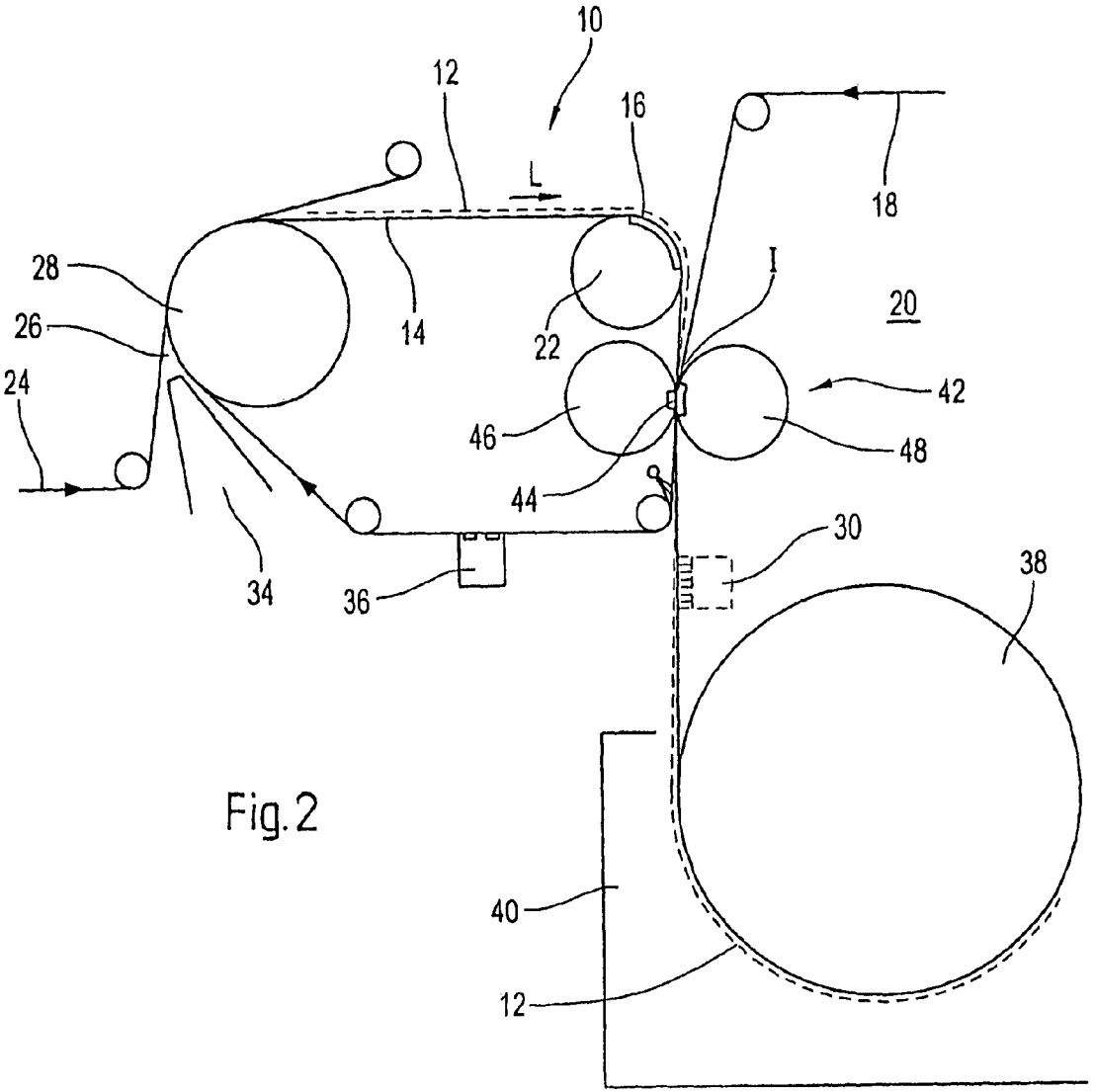
FIG. 2 is a schematic view of another embodiment of the machine according to the present invention with a shoe press arranged in the web transfer region.

FIG. 2 shows in a schematic view a modified form of machine 10. In this case, a shoe press 42 is provided in the region of web transfer position I through which fiber web 12 is guided together with soft clothing 14 with fine pores and TAD wire 18.

The length of press nip 44 of shoe press 42 considered in the web running direction L can expediently be selected to be larger than a value of approximately 80 mm, and preferably larger than or equal to approximately 85 mm, and in particular larger than or equal to approximately 120 mm. The shoe press can in particular be designed such that a pressure profile results over the press nip length with a maximum pressing pressure which is smaller than or equal to a value of approximately 2.5 MPa and in particular smaller than 2 MPa with a press shoe length of larger than or equal to approximately 120 mm. In this manner, a gentle pressing with a low pressing pressure is thus ensured and a larger dwell time and pressing time is secured due to the corresponding shoe length, whereby the molding effect is improved. Wet molding can therefore also already take place in the region of web transfer position I. In addition, suction element 30 likewise serving for the wet molding (see also FIG. 1) can also again be provided after this web transfer position I, but this is not mandatory in the present case.

Wet molding can therefore generally take place in each case in the region of web transfer position I or after web transfer position I or such wet molding can take place both in the region of web transfer position I and after web transfer position I.

Shoe press 42 includes a shoe pressing unit 46, in particular a shoe press roll, and, in the embodiment of FIG. 2, a suction roll or suction press on roll 48 cooperating with it and arranged inside the loop of TAD wire 18. In the present case, the two clothings 14, 18 have the same speed, i.e. wet creping does not take place here. In another respect, this embodiment can, for example, have the same design as that of FIG. 1. Parts corresponding to one another have been associated with the same reference numerals.

Figure 3:
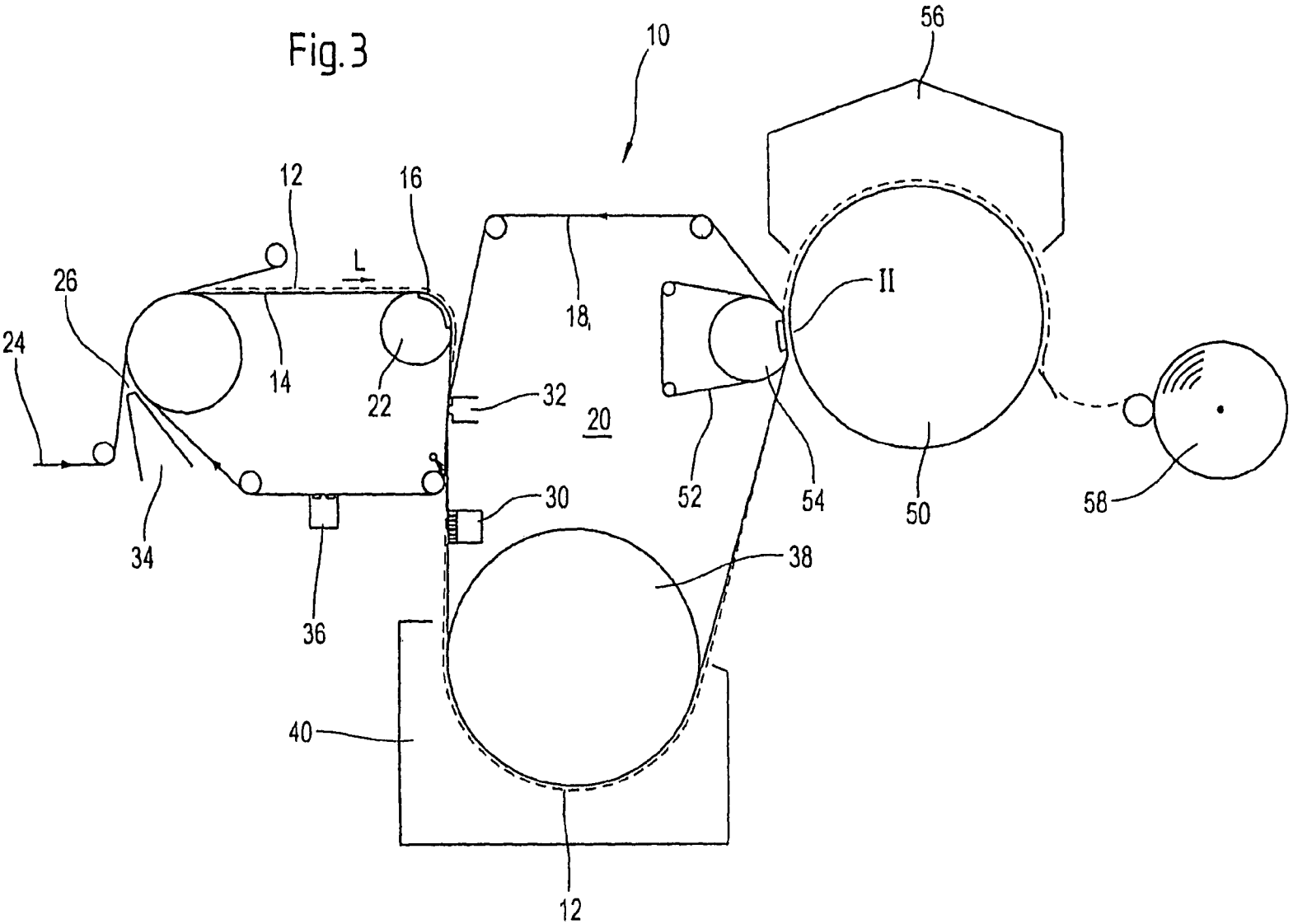
FIG. 3 is a schematic view of another embodiment of the machine according to the present invention in which the web transfer from the TAD wire to the drying cylinder is supported by a shoe pressing unit.

FIG. 3 shows in a schematic view of another embodiment of machine 10 whose forming zone and TAD zone are again designed at least substantially in the manner shown in FIG. 1, with again all modifications also being conceivable here. These forming zones, including all mentioned modifications, can thus also be designed such as was described in connection with the embodiment in accordance with FIG. 2. Elements corresponding to one another have been associated with the same reference numerals.

Moreover, outer clothing 24 not coming into contact with forming element 28 can be formed by a dewatering wire with zonally different wire permeability, which in particular brings about the advantage of a higher water absorption speed of fiber web 12. As can be recognized with reference to FIG. 3, fiber web 12 is transferred from the TAD wire 18 onto a drying cylinder 50, in particular onto a Yankee cylinder, after the TAD drying. In the present case, a shoe pressing unit 54, which can again preferably be a shoe press roll, which is preferably wrapped around by a soft felt or by a capillary felt 52 and includes a long shoe, is provided inside the loop of TAD wire 18 in web transfer region II. However, a suction press roll (SPW) or a press roll can also generally be provided in web transfer region II, for example. A hot air hood 56 is associated with drying cylinder 50. Web 12 is finally wound up to form a winding roll 58.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE SYMBOL LIST

10 machine
12 fiber web
14 soft clothing with fine pores
16 surface subject to suction, suction guide roll
18 TAD wire
20 TAD drying apparatus
22 suction guide roll
24 outer clothing
26 material inlet gap
28 forming element
30 suction element
32 pick-up or suction element
34 headbox
36 Uhle box (tube suction box)
38 TAD drum
40 drying hood
42 shoe press
44 press nip
46 show pressing unit
48 suction roll or suction press-on roll
50 drying cylinder, Yankee cylinder
52 soft felt, capillary felt
54 shoe pressing unit
56 hot air hood
58 winding roll
L web running direction
I web transfer section
II web transfer region

What is claimed is:

1. A method for the manufacture of a fiber web, comprising the steps of:

forming the fiber web on a soft clothing having fine pores;

providing a capillary effect with said soft clothing having said fine pores;

guiding said soft clothing and the fiber web over at least one surface subject to suction;

dewatering the fiber web by a combination of a suction being provided by both said at least one surface subject to suction and said capillary effect; and transferring the fiber web from said soft clothing directly onto a through air drying (TAD) wire of a TAD drying apparatus.

2. The method of claim 1, wherein the fiber web is one of a tissue web and a hygienic web.

3. The method of claim 1, wherein the fiber web is transferred to said TAD wire after said at least one surface subject to suction.

4. The method of claim 1, wherein at least one said surface subject to suction is curved.

5. The method of claim 1, wherein at least one said surface subject to suction is formed by a suction guide roll.

6. The method of claim 1, wherein at least one said surface subject to suction is formed by a shoe subject to suction.

7. The method of claim 1, further including the steps of dewatering the fiber web between two clothings which run together while forming a material inlet gap, said two clothings including an inner clothing, guiding the fiber web over a forming element and guiding the fiber web after said forming element by said inner clothing coming into contact with said forming element to said surface subject to suction.

8. The method of claim 7, wherein said forming element is a forming roll.

9. The method of claim 7, wherein said two clothings includes an outer clothing not coming into contact with said forming element, said outer clothing not coming into contact with said forming element is formed by an endless fabric.

10. The method of claim 9, wherein said endless fabric is a water permeable endless fabric.

11. The method of claim 7, wherein said forming element is a solid forming roll.

12. The method of claim 7, wherein said forming element is a suction forming roll.

13. The method of claim 1, further including the step of wet molding the fiber web on said TAD wire.

14. The method of claim 13, wherein said wet molding step takes place at at least one of a web transfer position and after said web transfer position.

15. The method of claim 1, further including the steps of dewatering the fiber web between two clothings which run together while forming a material inlet gap, said two clothings including an inner clothing, guiding the fiber web over a forming element and guiding the fiber web after said forming element by said inner clothing coming into contact with said forming element to said surface subject to suction, said two clothings including an outer clothing not coming into contact with said forming element, said outer clothing being a dewatering wire with zonally different wire permeability.

16. The method of claim 1, further including the step of transferring the fiber web from said TAD wire onto a drying cylinder after said step of transferring the fiber web from said soft clothing onto a TAD wire of a TAD drying apparatus.

17. The method of claim 16, wherein said drying cylinder is a Yankee cylinder.

18. The method of claim 16, further including a shoe pressing unit having a longitudinal shoe, said shoe pressing unit is wrapped around by one of a soft felt and a capillary felt, said shoe pressing unit is provided inside a loop of said TAD wire in a web transfer region.

19. The method of claim 18, wherein said shoe pressing unit is a shoe press roll.

20. The method of claim 16, wherein said transferring step is ensured by one of a suction press roll and a press roll not subject to suction.

21. A machine for the manufacturing of a fiber webs comprising:

a soft clothing with fine pores, the fiber web being formed on said soft clothing with fine pores;

a surface subject to suction said soft clothing with fine pores being guided over said surface subject to suction;

a TAD wire of a TAD drying apparatus, the fiber web being transferred from said soft clothing with fine pores onto said TAD wire; and two clothings which run together while forming a material inlet gap, said two clothings including an inner clothing an outer clothing, said inner clothing having a different running speed than said outer clothing, said different running speed to produce a crepe effect acting on the fiber web.

22. A method for the manufacture of a fiber webs comprising the steps of:

forming the fiber web on a soft clothing having fine pores;

guiding said soft clothing and the fiber web over at least one surface subject to suction;

transferring the fiber web from said soft clothing directly onto a TAD wire of a TAD drying apparatus; and dewatering the fiber web between two clothings which run together while forming a material inlet gap, said two clothings including an inner clothing an outer clothing, said inner clothing having a different running speed than said outer clothing, said different running speed to produce a crepe effect acting on the fiber web.

23. The method of claim 1, wherein said soft clothing having fine pores is formed by at least one of a felt, a capillary felt and a capillary membrane.

24. The method of claim 23, wherein said soft clothing having fine pores is formed by a felt with a foamed layer.

25. The method of claim 24, wherein said foamed layer includes a plurality of pores, said foamed layer is selected such that each of said plurality of pores are approximately between 3 $\mu$m and 6 $\mu$m.

26. The method of claim 1, further including the step of wet molding the fiber web on said TAD wire, at least one suction element being arranged inside a loop of said TAD wire, said at least one suction element being used for said wet molding.

27. The method of claim 1, further including a loop of said TAD wire, one of a pick-up element and a suction element is provided inside said loop in a region of a web transfer position.

28. The method of claim 1, further including the step of wet molding the fiber web on said TAD wire, at least one suction element serving for said wet molding of the fiber web being provided inside a loop of said TAD wire in a region of at least one of a web transfer position and after said web transfer position.

29. The method of claim 1, further including a shoe press provided in a region of a web transfer position, the fiber web is guided together with said soft clothing having fine pores and said TAD wire through said shoe press.

30. The method of claim 29, wherein said shoe press includes a press nip with a press nip length in a running direction of the fiber web, said press nip length larger than approximately 80 mm, said shoe press is designed such that a pressing profile results over said press nip length, said pressing profile has a pressing pressure of no more than approximately 2.5 MPa, said shoe press has a shoe press length of at least approximately 120 mm.

31. The method of claim 30, wherein said press nip length is at least approximately 85 mm.

32. The method of claim 30, wherein said press nip length is at least approximately 120 mm.

33. The method of claim 30, wherein said pressing pressure is less than approximately 2.0 MPa.

34. The method of claim 29, wherein said shoe press includes a shoe pressing unit and a wire roll cooperating with said shoe pressing unit, said shoe pressing unit arranged inside a loop of said TAD wire.

35. The method of claim 34, wherein said shoe pressing unit is a shoe press roll.

36. The method of claim 29, further including the step of dewatering the fiber web between two clothings which run together while forming a material inlet gap, said two clothings including an inner clothing an outer clothing, said inner clothing having a same running speed as said outer clothing.

37. The method of claim 29, further including a suction element following said shoe press, the fiber web being wet molded by both said suction element and said shoe press.

38. A machine for the manufacturing of a fiber web, comprising:

a soft clothing with fine pores, the fiber web being formed on said soft clothing with fine pores, said soft clothing having said fine pores providing a capillary effect;

a surface subject to suction, said soft clothing with fine pores being guided over said surface subject to suction, the fiber web being dewatered by a combination of a suction being provided by both said at least one surface subject to suction and said capillary effect; and a TAD wire of a TAD drying apparatus, the fiber web being transferred from said soft clothing with fine pores onto said TAD wire.

39. The machine of claim 38, wherein the fiber web is one of a tissue web and a hygienic web.

40. The machine of claim 38, wherein the fiber web is transferred to said TAD wire after said surface subject to suction.

41. The machine of claim 38, wherein said surface subject to suction is curved.

42. The machine of claim 38, wherein said surface subject to suction is formed by a suction guide roll.

43. The machine of claim 38, wherein said surface subject to suction is formed by a shoe subject to suction.

44. The machine of claim 38, further including two clothings which run together while forming a material inlet gap, said two clothings being guided over a forming element, said two clothings including an inner clothing in contact with said forming element, the fiber web being dewatered between said two clothings, the fiber web being guided after said forming element by said inner clothing coming into contact with said forming element to said surface subject to suction.

45. The machine of claim 44, wherein said forming element is a forming roll.

46. The machine of claim 44, wherein said two clothings includes an outer clothing not coming into contact with said forming element, said outer clothing not coming into contact with said forming element is formed by an endless fabric.

47. The machine of claim 46, wherein said endless fabric is a water permeable endless fabric.

48. The machine of claim 44, wherein said forming element is a solid forming roll.

49. The machine of claim 44, wherein said forming element is a suction forming roll.

50. The machine of claim 38, further including a wet molding of the fiber web on said TAD wire.

51. The machine of claim 50, further including a web transfer position where the fiber web being transferred from said soft clothing with fine pores onto said TAD wire, said wet molding of the fiber web takes place at at least one of said web transfer position and after said web transfer position.

52. The machine of claim 38, wherein said soft clothing having fine pores is formed by at least one of a felt, a capillary felt and a capillary membrane.

53. The machine of claim 52, wherein said soft clothing having fine pores is formed by a felt with a foamed layer.

54. The machine of claim 53, wherein said foamed layer includes a plurality of pores, said foamed layer is selected such that each of said plurality of pores are approximately between 3 $\mu$m and 6 $\mu$m.

55. The machine of claim 38, further including a loop of said TAD wire and at least one suction element being arranged inside said loop of said TAD wire, said at least one suction element being provided for a wet molding of the fiber web.

56. The machine of claim 38, further including a loop of said TAD wire and a web transfer position where the fiber web being transferred from said soft clothing with fine pores onto said TAD wire, one of a pick-up element and a suction element is provided inside said loop in a region of said web transfer position.

57. The machine of claim 38, further including a loop of said TAD wire and a web transfer position where the fiber web being transferred from said soft clothing with fine pores onto said TAD wire, at least one suction element serving for a wet molding of the fiber web being provided inside said loop of said TAD wire in a region of at least one of said web transfer position and after said web transfer position.

58. The machine of claim 38, further including a web transfer position where the fiber web being transferred from said soft clothing with fine pores onto said TAD wire, a shoe press provided in a region of said web transfer position, the fiber web is guided together with said soft clothing having fine pores and said TAD wire through said shoe press.

59. The machine of claim 58, wherein said shoe press includes a press nip with a press nip length in a running direction of the fiber web, said press nip length larger than approximately 80 mm, said shoe press is designed such that a pressing profile results over said press nip length, said pressing profile has a pressing pressure of no more than approximately 2.5 MPa, said shoe press has a shoe press length of at least approximately 120 mm.

60. The machine of claim 59, wherein said press nip length is at least approximately 85 mm.

61. The machine of claim 59, wherein said press nip length is at least approximately 120 mm.

62. The machine of claim 59, wherein said pressing pressure is less than approximately 2.0 MPa.

63. The machine of claim 58, further including a loop of said TAD wire, said shoe press includes a shoe pressing unit and a wire roll cooperating with said shoe pressing unit, said shoe pressing unit arranged inside said loop of said TAD wire.

64. The machine of claim 63, wherein said shoe pressing unit is a shoe press roll.

65. The machine of claim 58, further including two clothings which run together while forming a material inlet gap, the fiber web being dewatered between said two clothings, said two clothings including an inner clothing an outer clothing, said inner clothing having a same running speed as said outer clothing.

66. The machine of claim 58, further including a suction element following said shoe press, the fiber web being wet molded by both said suction element and said shoe press.

67. The machine of claim 38, further including two clothings which run together while forming a material inlet gap, said two clothings being guided over a forming element, said two clothings including an inner clothing in contact with said forming element, the fiber web being dewatered between said two clothings, the fiber web being guided after said forming element by said inner clothing coming into contact with said forming element to said surface subject to suction, said two clothings including an outer clothing not coming into contact with said forming element, said outer clothing being a dewatering wire with zonally different wire permeability.

68. The machine of claim 38, further including a drying cylinder after said TAD drying apparatus, the fiber web being transferred from said TAD wire onto said drying cylinder.

69. The machine of claim 68, wherein said drying cylinder is a Yankee cylinder.

70. The machine of claim 68, further including a web transfer region where the fiber web being transferred from said soft clothing with fine pores onto said TAD wire, a loop of said TAD wire and a shoe pressing unit having a longitudinal shoe, said shoe pressing unit is wrapped around by one of a soft felt and a capillary felt, said shoe pressing unit is provided inside said loop of said TAD wire in said web transfer region.

71. The machine of claim 70, wherein said shoe pressing unit is a shoe press roll.

72. The machine of claim 68, further including a web transfer region where the fiber web being transferred from said soft clothing with fine pores onto said TAD wire, one of a suction press roll and a press roll not subject to suction being provided in said web transfer region.

* * * * *

UNITED STATES PATENT AND TRADEMARK OFFICE

CERTIFICATE OF CORRECTION

PATENT NO. : 6,986,830 B2
DATED : January 17, 2006
INVENTOR(S) : Scherb et al.

It is certified that error appears in the above-identified patent and that said Letters Patent is hereby corrected as shown below:

Column 4,
Line 58, after "wire 18 in", delete "on", and substitute -- the region --.

Column 7,
Line 48, delete "webs", and substitute -- web, --;
Line 52, between "suction" and "said", insert -- , --; and
Line 63, delete "webs", and substitute -- web, --.

Signed and Sealed this

Thirteenth Day of June, 2006

JON W. DUDAS
*Director of the United States Patent and Trademark Office*